US005189994A

United States Patent [19]

Gindentuller

[11] Patent Number: 5,189,994

[45] Date of Patent: Mar. 2, 1993

[54] INTERNAL COMBUSTION ENGINE

[76] Inventor: Ilya Gindentuller, 407 Avenue G, Apt. 32, Redondo Beach, Calif.

[21] Appl. No.: 747,615

[22] Filed: Aug. 20, 1991

[51] Int. Cl.[5] ..... F02B 75/22

[52] U.S. Cl. ..... 123/55 R; 123/58 R; 123/197.4

[58] Field of Search ..... 123/197.4, 55 R, 52 R, 123/54 R, 54 A, 58 R

[56] References Cited

U.S. PATENT DOCUMENTS

| | | | |
|---|---|---|---|
| 1,607,431 | 11/1926 | Brice | 123/55 R |
| 2,466,550 | 4/1949 | Lundquist | 123/52 R |
| 2,844,040 | 7/1958 | Bancroft | 123/55 R |
| 3,175,544 | 3/1965 | Hughes . | |
| 3,831,565 | 8/1974 | Avery | 123/47 AA |
| 4,450,754 | 5/1984 | Liljequist | 123/193 P |
| 4,682,569 | 7/1987 | Stiller et al. | 123/55 A |
| 4,850,313 | 7/1989 | Gibbons | 123/55 R |
| 4,899,705 | 2/1990 | Reed | 123/197 AC |
| 5,025,759 | 6/1991 | Wenzel et al. | 123/197.4 |

*Primary Examiner*—David A. Okonsky
*Attorney, Agent, or Firm*—Spensley Horn Jubas & Lubitz

[57] ABSTRACT

An internal combustion engine or like apparatus is disclosed utilizing an "ellipsograph" mechanism for converting the reciprocating motion of one or more pistons into rotational motion of an output element. The apparatus includes an orbital crankshaft coupled to the pistons by connecting rods and linear slide mechanisms and providing power to an output shaft through one or more crank and gear assemblies. Counterweights on the orbital crankshaft and crank and gear assemblies compensate for inertial forces and unbalancing moments.

18 Claims, 19 Drawing Sheets

INTERNAL COMBUSTION ENGINE

BACKGROUND OF THE INVENTION

1. Field Of The Invention

The present invention relates to internal combustion engines and like apparatus of the kind utilizing an elliptic trammel type linkage or "ellipsograph" mechanism for converting the reciprocating motion of one or more pistons into rotational motion of an output element.

2. Description Of The Prior Art

As is well known, conventional internal combustion engines utilize piston rod and crank mechanisms for converting the reciprocating motion of the pistons into rotational motion of an output shaft. Such conventional mechanisms have certain drawbacks. For example, the piston and cylinder wall surfaces wear substantially as a result of side thrust forces. These side forces may also cause significant power losses due to friction. Piston/-cylinder mismatches may also cause jamming of the pistons. Moreover, these conventional engines often lack appropriate balancing means, so that non-balanced, secondary inertial forces constrain the angular velocity of the output shaft thereby limiting increases in power output. Still further, conventional crankshafts tend to be massive, reflecting the strength that is built into them in order to handle full output torque. Durability is sometimes compromised because of insufficient lubrication of the pistons working in a high-temperature environment.

A known alternative to the conventional piston rod and crank mechanism is based on the elliptic trammel linkage, or "ellipsograph" mechanism. However, the efficiency, piston stroke, piston speed, power output and life of many of these engine designs are limited and they tend to be large, heavy and subject to jamming. In some cases, the side loads imposed on the pistons are such that there is an unacceptable degree of piston and cylinder wear. Other known engines employing the ellipsograph principle fail to provide any balancing means to compensate for inertial forces and other dynamic unbalancing loads.

Accordingly, it is an object of the present invention to provide an internal combustion engine or like apparatus which produces more power and operates more efficiently.

It is another object of the present invention to provide an internal combustion engine or like apparatus which reduces piston and cylinder wear.

It is another object of the present invention to provide an internal combustion engine or like apparatus which is durable, has a long service life and has superior reliability.

It is another object of the present invention to provide an internal combustion engine or like apparatus providing smooth, quiet operation across a broad range of operating speeds and loads.

It is another object of the present invention to provide an internal combustion engine or like apparatus which is compact and which can be manufactured easily and inexpensively.

SUMMARY OF THE INVENTION

In accordance with the broader aspects of the present invention, there is provided an internal combustion engine or like apparatus including at least one cylinder disposed along a first axis and a piston reciprocable in the at least one cylinder. The piston is connected to a first guide reciprocable in a first linear guideway in alignment with the at least one cylinder. A second linear guideway is disposed along a second axis orthogonal to the first axis and offset therefrom along a third axis mutually orthogonal to the first and second axes. A second guide is disposed in the second guideway and is reciprocable therein The apparatus further includes an orbital crankshaft including crank means having first and second crank pins journaled in the first and second guides, respectively. Last, means rotatable about the third axis and coupled to the crankshaft at a point midway between the crank pins provides output power from the engine.

In accordance with one specific exemplary embodiment of the present invention, there is provided an improved engine having a first pair of opposed cylinders disposed along a first, or X axis, with a piston reciprocable in each cylinder. The engine further includes a first linear guideway in alignment with the first pair of cylinders. A first guide rigidly coupled to the first pair of pistons is disposed in the guideway for reciprocation therein. A second pair of opposed cylinders is disposed along a second or Y axis orthogonal to the X axis, the Y axis being offset from the X axis along a third or Z axis mutually orthogonal to the X and Y axes. A piston is received in each of the second pair of cylinders for reciprocation therein along the Y axis. A second linear guideway is provided in alignment with the second pair of cylinders and a second guide, rigidly coupled to the second pair of pistons and reciprocable therewith, is received in the second guideway. An orbital crankshaft, including crank means having first and second crank pins journaled in the first and second guides, converts the reciprocating motion of the pistons into rotational motion of a power output means rotatable about the Z axis and coupled to the crankshaft at a point midway between the pins.

In accordance with another specific aspect of the invention, the output power providing means includes at least one crank and gear assembly rotatable about the Z axis. A power output shaft offset from and parallel with the third axis is coupled to receive power from the at least one crank and gear assembly. In accordance with other forms of the invention, two or three crank and gear assemblies may be provided, engines incorporating such plural crank and gear assemblies having increasingly higher power output capabilities resulting from, among other things, the use of a greater number of bearings.

BRIEF DESCRIPTION OF THE DRAWINGS

Further objects, features and advantages of the invention will become evident from the ensuing detailed description when taken in conjunction with the accompanying drawings in which.

DETAILED DESCRIPTIONS OF THE PREFERRED EMBODIMENTS

It is to be understood that the preferred embodiments described herein merely exemplify the invention which may take forms different from the specific embodiments described. For example, while the detailed descriptions of the preferred embodiments are directed principally to internal combustion engines, it is to be understood that the principles of the invention are equally applicable to engines driven hydraulically or pneumatically, as well as to pumps and compressors, and that the appended claims are intended to encompass such alternative apparatus.

Figure 1:
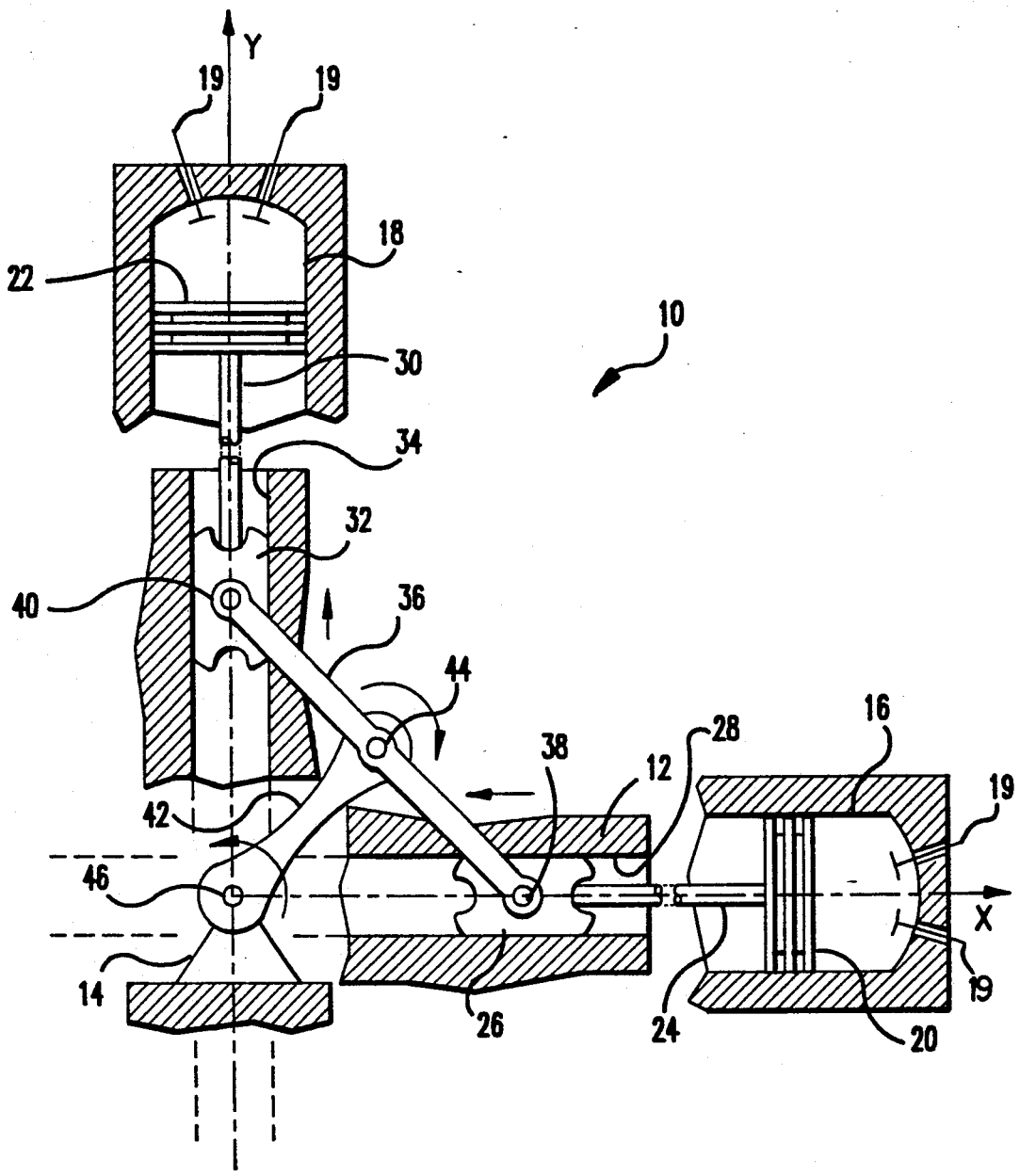
FIG. 1 is an end elevation view of a two-dimensional, schematic representation of an internal combustion engine illustrating the principles of the ellipsograph mechanism.

Referring to FIG. 1, which shows a two-dimensional schematic representation of an engine 10 employing the "ellipsograph" principle, the engine 10 includes an engine block or casing 12 carrying a crankshaft bearing 14. The casing 12 defines a horizontal cylinder 16 and a vertical cylinder 18 disposed orthogonally relative to each other along an X axis and a Y axis, respectively. The cylinders 16 and 18 are provided with intake and exhaust valves 19 whose structural features, actuation mechanism and operation are all well known in the art and are therefore not shown or described in detail. Pistons 20 and 22 are received for reciprocation within the cylinders 16 and 18, respectively. A connecting rod 24 couples the piston 20 with a horizontal guide in the form of a slide 26 movable within a linear guideway 28 aligned with the X axis; similarly, a connecting rod 30 couples the piston 22 with a vertical guide in the form of a slide 32 movable within a linear guideway 34 disposed along the Y axis. A link 36, which hereinafter will be referred to as an "orbital crankshaft", connects the slides 26 and 32 at end points 38 and 40. Last, a power output crank 42 having one end connected to the midpoint 44 of the orbital crankshaft 36 and its other end journaled in the bearing 14, is rotatable about a central point 46 lying on a longitudinal Z axis mutually orthogonal to the X and Y axes.

It will be evident that the two-dimensional mechanism of FIG. 1 is theoretical only; for example, the intersecting guideways 28 and 34 would preclude realization of a practical engine which would require that the guideways be offset along the Z axis.

In the operation of the engine shown schematically in FIG. 1, as the pistons 20 and 22 reciprocate in their respective cylinders and with the pistons alternately reaching their top and bottom dead centers, the ends 38 and 40 of the orbital crankshaft reciprocate between their horizontal and vertical endpoints equidistant from the Z axis represented by the point 46. The output crank 42 is thereby driven with uniform angular velocity, with the point 44 describing a circle centered on the Z axis. Also, as is well known, a point lying on the orbital crankshaft intermediate the midpoint 44 and either end point 38 or 40 will describe an ellipse. It will also be evident to those skilled in the art that the engine shown in FIG. 1, as well as those to be described in connection with the preferred embodiments, may be designed to be either single- or double-acting.

The preferred embodiments which will now be described comprise internal combustion engines applying the principle described in connection with FIG. 1.

Figure 2:
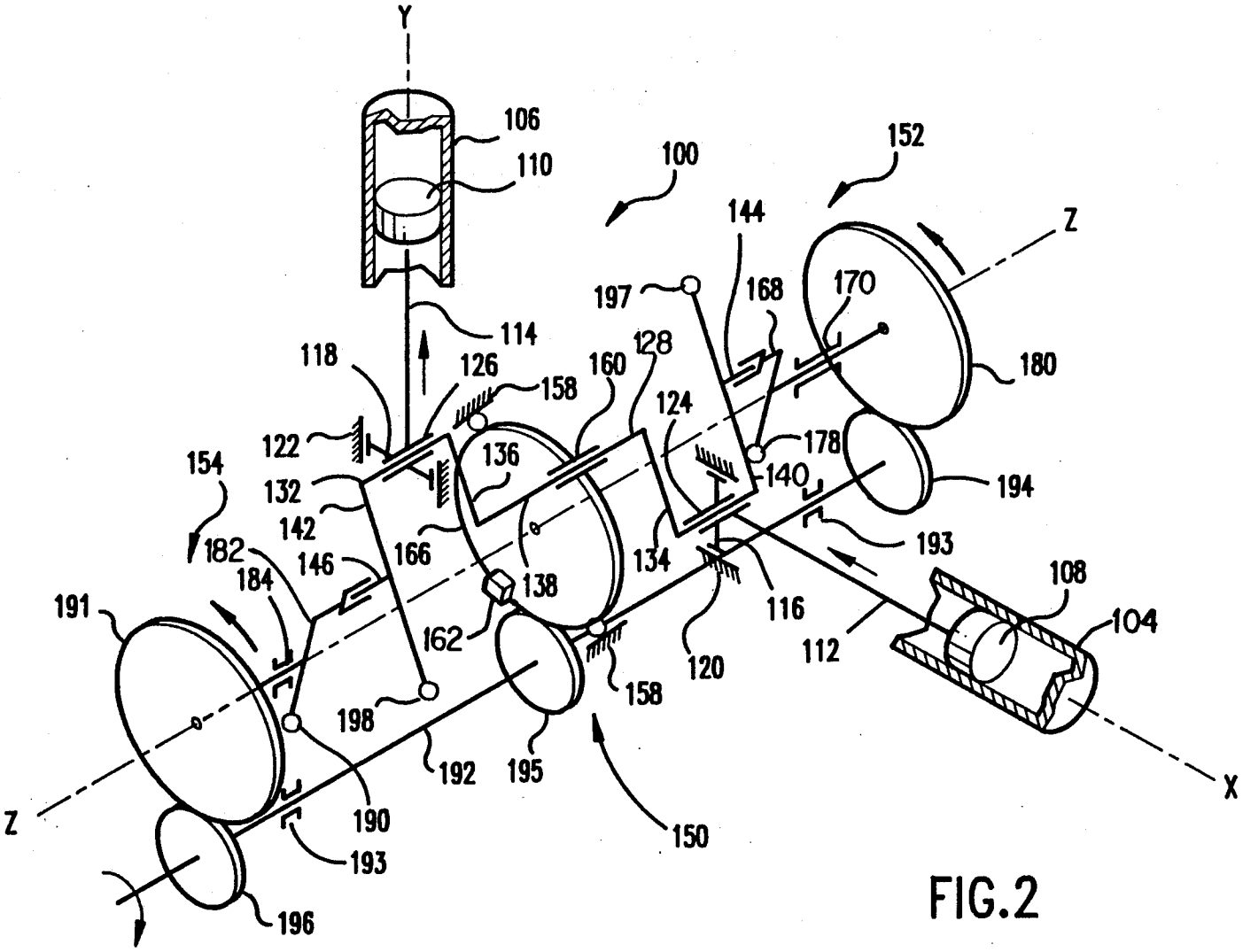
FIG. 2 is a perspective view of a schematic representation of a first embodiment of an internal combustion engine in accordance with the present invention.
Figure 3:
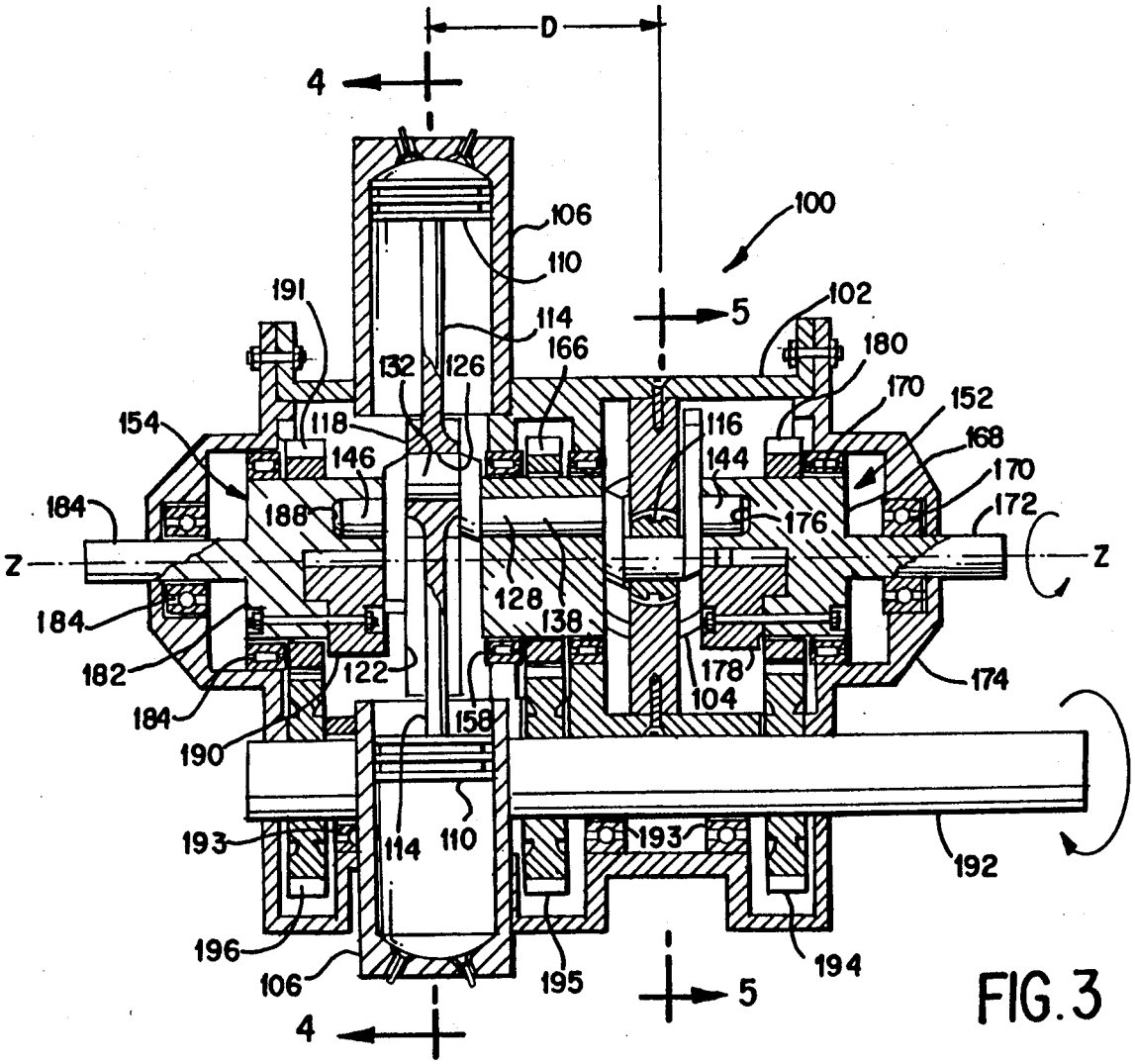
FIG. 3 is a side elevation view, in cross section, of a practical engine in accordance with the first embodiment of the invention.
Figure 4:
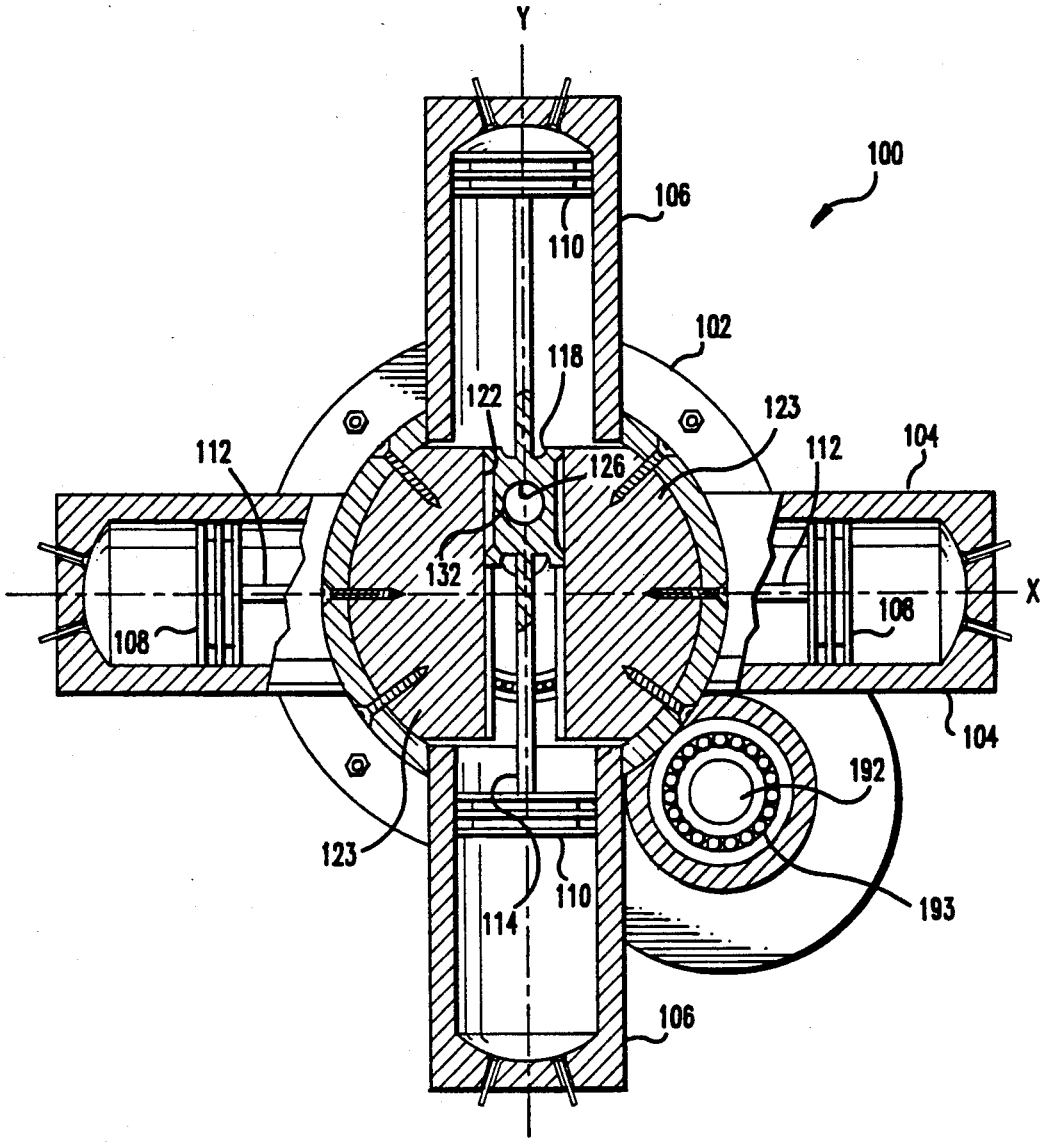
FIGS. 4 and 5 are transverse cross sectional views of the engine of FIG. 3 as seen along the lines 4—4 and 5—5, respectively, in FIG. 3.
Figure 6:
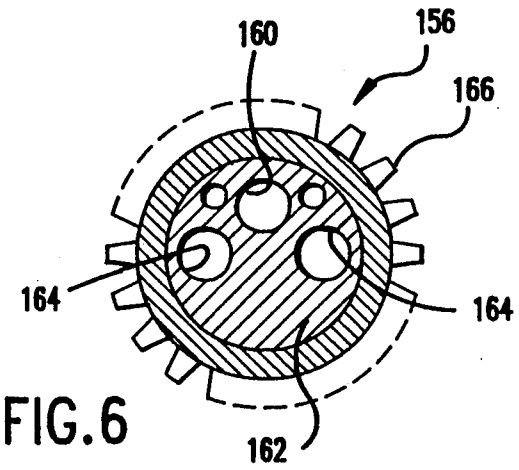
FIG. 6 is an end elevation view, in cross section, of a crank and gear assembly utilized in the engine of FIG. 3.
Figure 5:
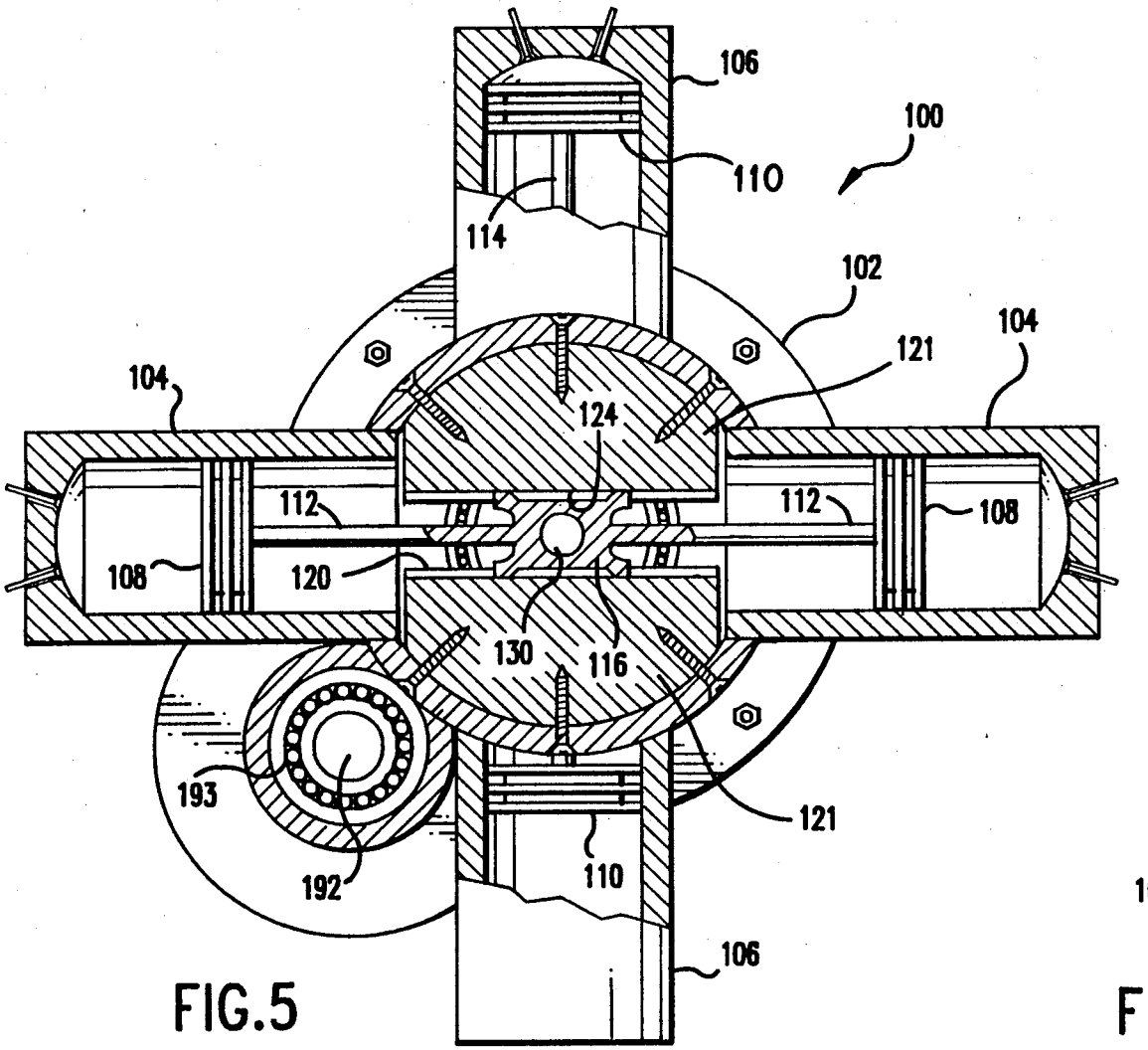

A first practical embodiment of the invention is shown in FIGS. 2-6. In this embodiment, an engine 100 includes a casing 102 carrying opposed pairs of horizontal and vertical cylinders 104 and 106, respectively. (For clarity, only one of each of the pairs of cylinders is shown in FIG. 2.) As best seen in FIG. 3, the opposed cylinders 104 and 106, which extend along orthogonal X and Y axes, respectively, are separated or offset from each other by a distance D along a Z axis mutually orthogonal to the X and Y axes. Cylinders 104 and 106 contain reciprocable pistons 108 and 110, respectively, which are connected, via connecting rods 112 and 114, to guides 116 and 118. The guides 116 and 118 are reciprocable in guideways 120 and 122 in alignment or coaxial with the cylinders 104 and 106. The guideway 120 is defined by the edges of a pair of spaced apart, aligned plates 121 secured to the casing 102 and lying in a plane perpendicular to the Z axis (FIG. 5). Similarly, the guideway 122 is defined by a pair of spaced apart plates 123 (FIG. 4). In this embodiment, the guides are in the form of slides. The slide 116 has a bore or bearing surface 124 extending parallel with the Z axis; similarly a bearing surface 126, parallel with the Z axis, is formed in the slide 118.

The engine of FIGS. 2-6 further includes an orbital crankshaft 128 the various components of which are coplanar as best seen in FIG. 2. The crankshaft 128 includes opposed crank pins 130 and 132 spaced apart by the distance D in the Z axis direction and journaled in the bearings 124 and 126, respectively. Cranks 134 and 136 connect the crank pins 130 and 132 to a central shaft 138 parallel with the Z axis. Cranks 134 and 136 are of equal length so that the central shaft 138 is positioned midway between the crank pins 130 and 132. The crankshaft 128 further includes end cranks 140 and 142 terminating in stub shafts 144 and 146, respectively, projecting outwardly in the Z axis direction coaxially with the central shaft 138.

The engine 100 further includes a central crank and gear assembly 150 and end crank and gear assemblies 152 and 154. The central crank and gear assembly 150 (also seen in the section view of FIG. 6) includes a cylindrical crank member 156 journaled for rotation in bearings 158 carried by the engine casing 102. The crank member 156 has a longitudinally extending, eccentric bore or bearing surface 160 receiving the central shaft 138 of the crankshaft 128. The portion 162 of the crank member 156 diametrically opposite the bore 160 functions as a counterweight as a result of lightening holes 164 formed in the crank member 156 adjacent the bore 160. Secured to the outer surface of the crank member 156 is a circular or ring gear 166 whose rotational axis lies on the Z axis.

The end crank and gear assembly 152 comprises a cylindrical crank member 168 journaled for rotation in bearings 170. The crank member 168 may include an end shaft 172 (which can be utilized as an intermediate output of the engine) projecting from an end cover 174 of the engine casing. The crank member 168 further has a longitudinal, eccentrically disposed counterbore 176 for receiving the stub shaft 144. A counterweight 178 is secured to the crank member 168 diametrically opposite the counterbore 176. Affixed to the outer surface of the crank member 168 is a ring gear 180 rotatable about the Z axis.

The end crank and gear assembly 154 is similar to the assembly 152, including a crank member 182 journaled in bearings 184; an end shaft 186; a counterbore 188 in the member 182 for receiving the stub shaft 146; a counterweight 190; and a ring gear 191.

The engine 100 also has a power output shaft 192 supported by bearings 193 along an axis offset from and parallel with the Z axis. Attached to the output shaft 192 are three gears 194, 195 and 196 in mesh with the ring gears 180, 166 and 191, respectively. The gear sets 180/194, 195/166 and 196/191 not only serve to transmit power from the crankshaft 128 to the output shaft 192, but also function to synchronize the rotation of the crank and gear assemblies 150, 152 and 154 and to maintain the precise alignment of those assemblies and the orbital crankshaft along the Z axis. Any tendency for those components to jam is thereby eliminated.

Counterweights 197 and 198 are also included as extensions of the end cranks 140 and 142, respectively. The five counterweights 162, 178, 190, 197 and 198 compensate for inertial forces and unbalanced moments; the dynamic analyses to determine their masses, configuration and placement to assure smooth engine performance at all operating speeds and loads are well within the knowledge of the skilled artisan and therefore need not be explained here.

Because the orbital crankshaft of the first embodiment of FIGS. 2–6 is supported at three locations by the bearings sets 158, 170 and 184, the engine of this embodiment may be designed to generate and transmit high torque and power levels.

It will be seen that the first embodiment incorporates the basic principle described in connection with FIG. 1, with the orbital crankshaft 128 being analogous to the crankshaft 36 of FIG. 1 and the crank and gear assemblies 150, 152 and 154 being analogous to the output crank 42 of FIG. 1.

Accordingly, in operation, as the pistons 108 and 110 reciprocate within their respective cylinders, the crank pins 130 and 132 move linearly between top and bottom dead centers driving the central shaft 138 and stub shafts 144 and 146 in a counterclockwise, circular path about the Z axis. The crank and gear assemblies 150, 152 and 154, driven by these shafts, in turn drive the output shaft 192 (clockwise in the example shown) through the gears 194, 195 and 196.

Figure 7:
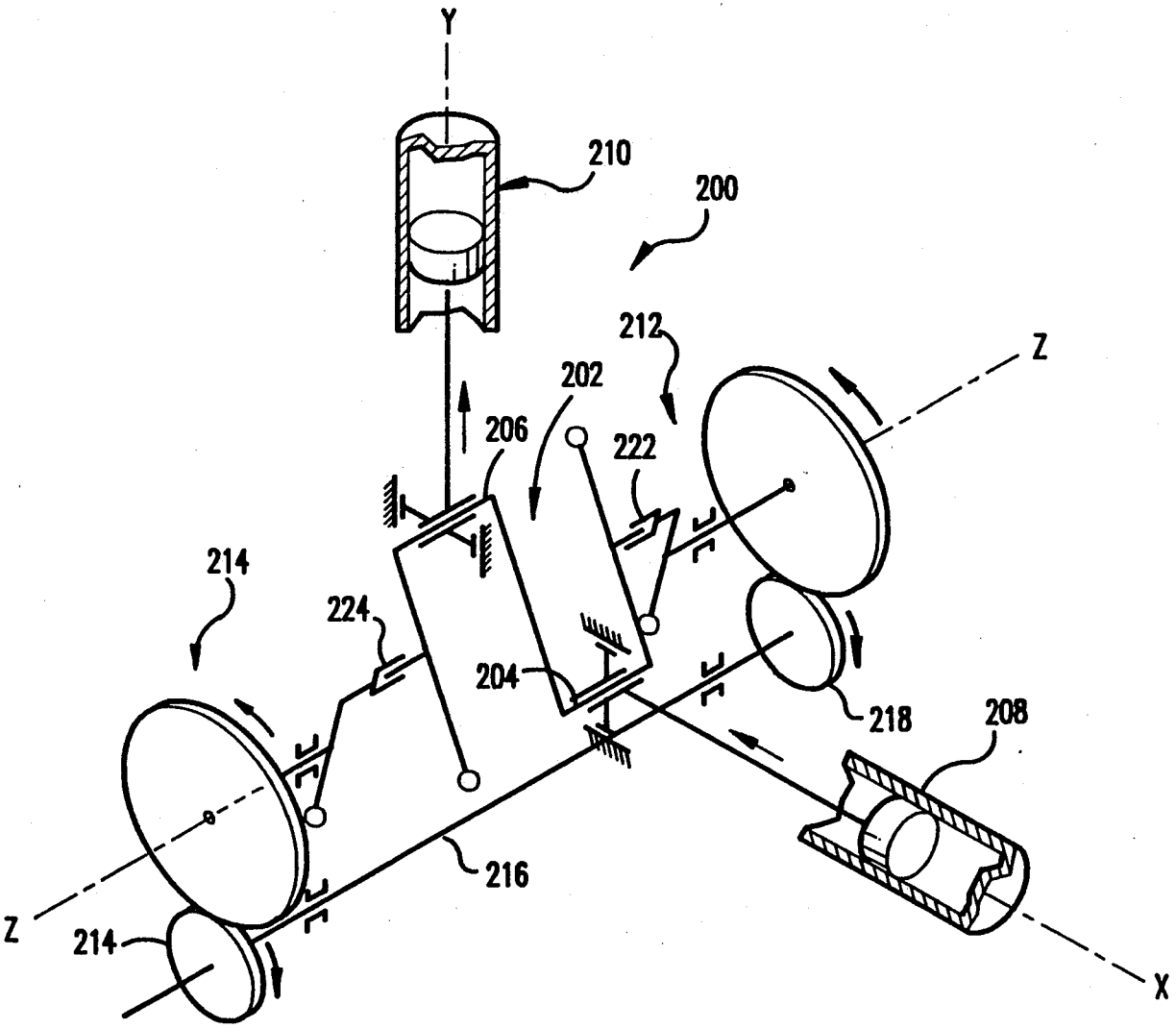
FIG. 7 is a perspective view of a schematic representation of a second embodiment of an internal combustion engine in accordance with the present invention.
Figure 8:
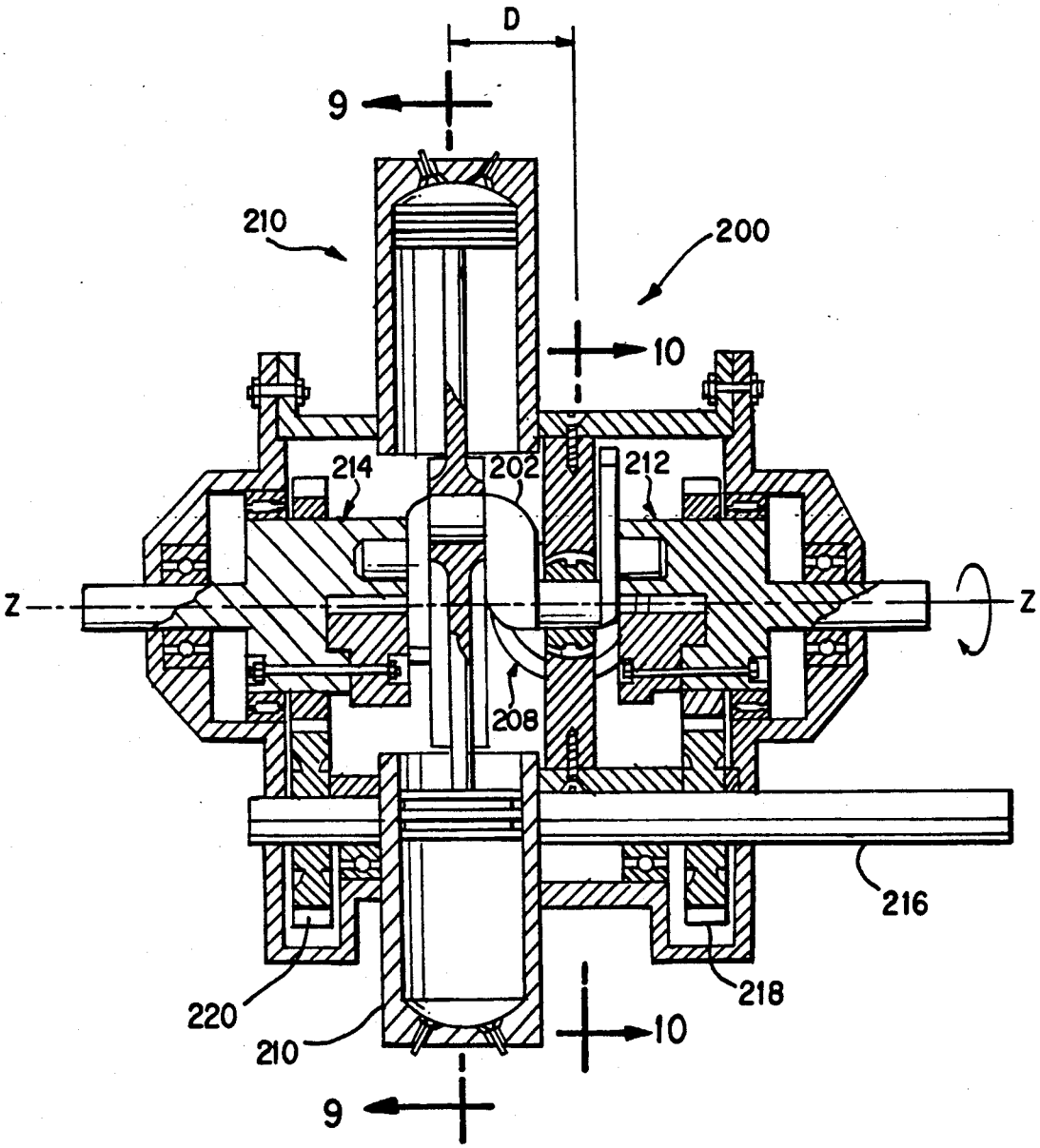
FIG. 8 is a side elevation view, in cross section, of a practical engine in accordance with the second embodiment of the invention.
Figure 9:
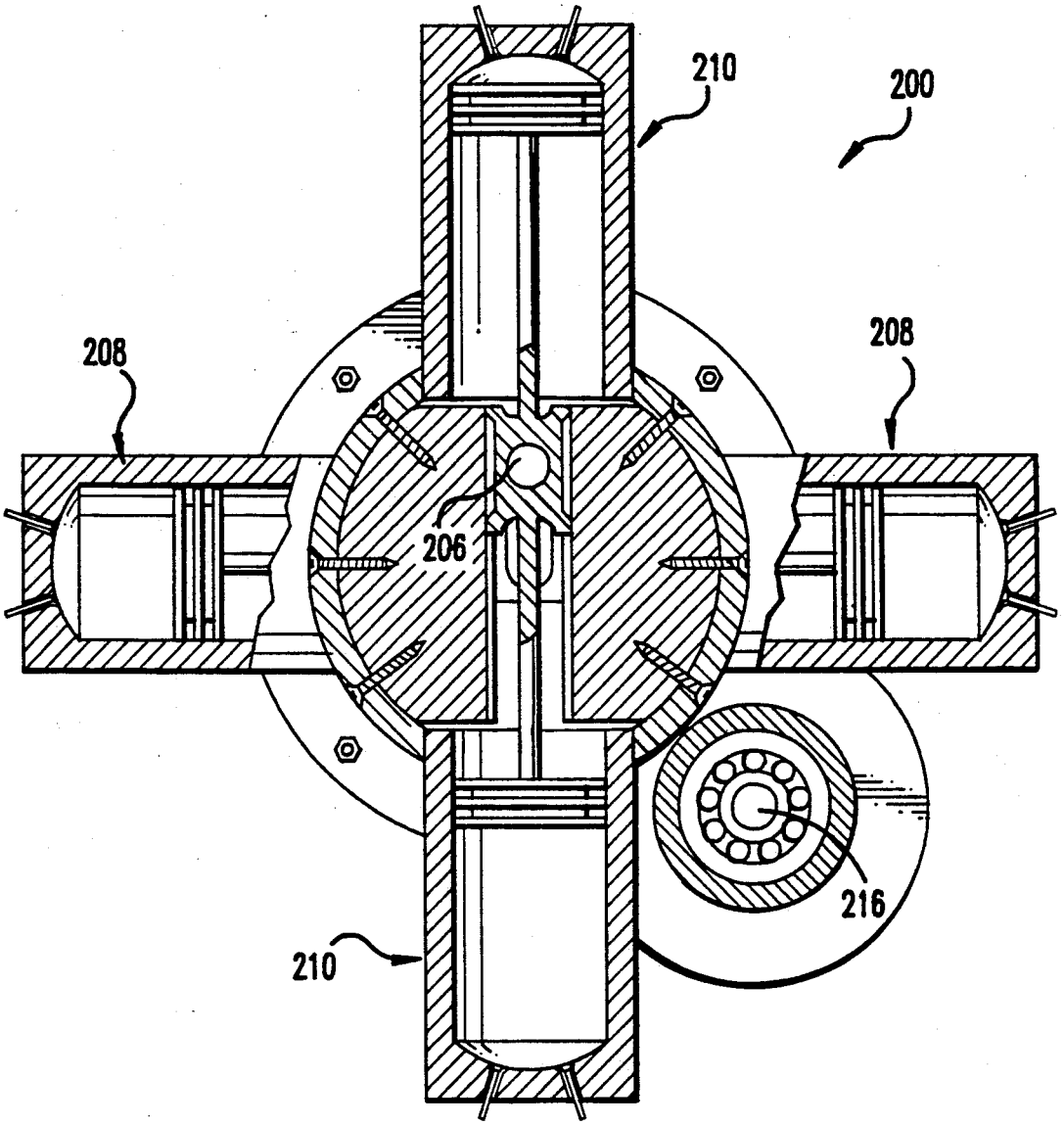
FIGS. 9 and 10 are transverse cross section views of the engine of FIG. 8 as seen along the lines 9—9 and 10—10, respectively, in FIG. 8.
Figure 10:
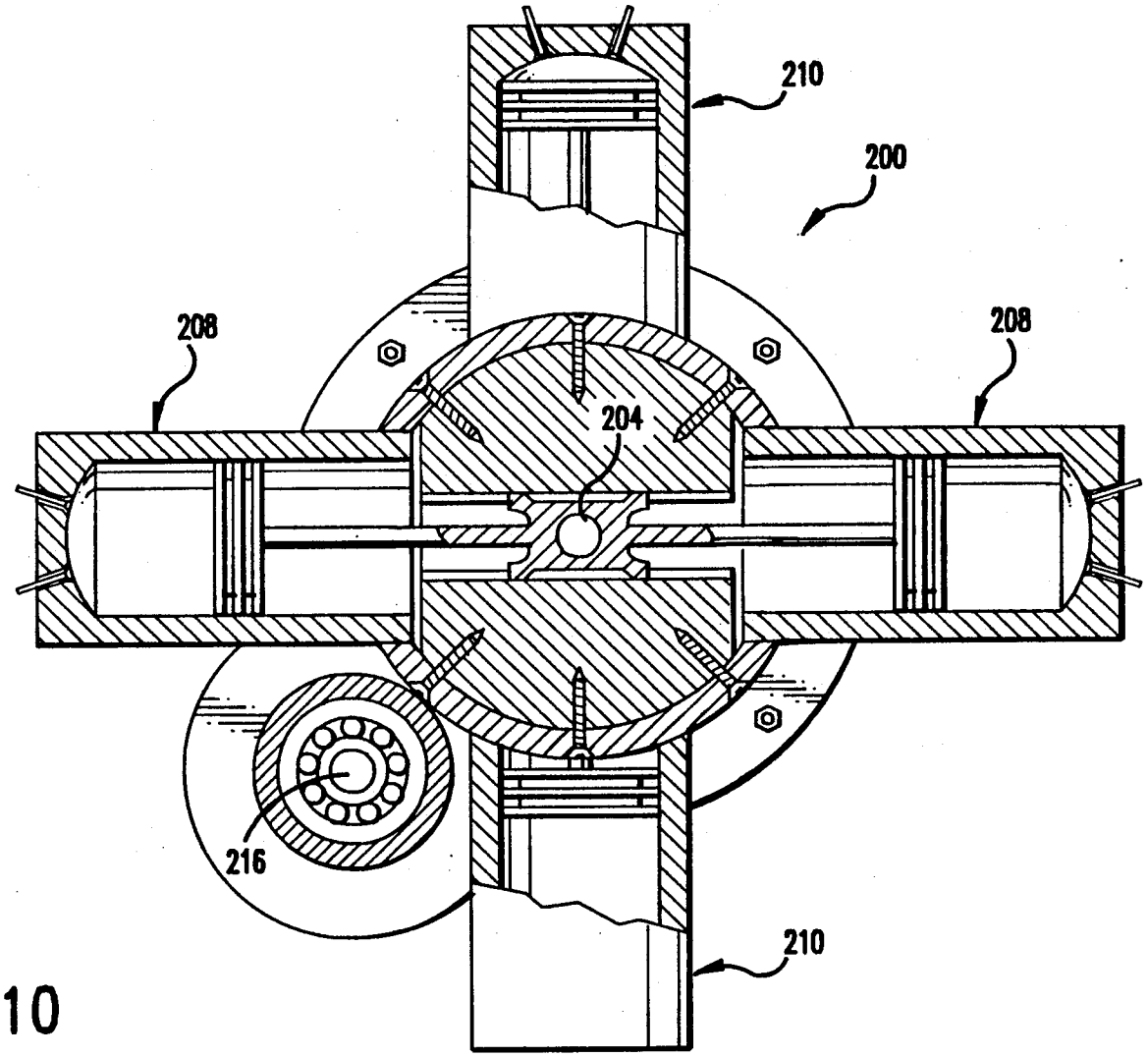
Figure 11:
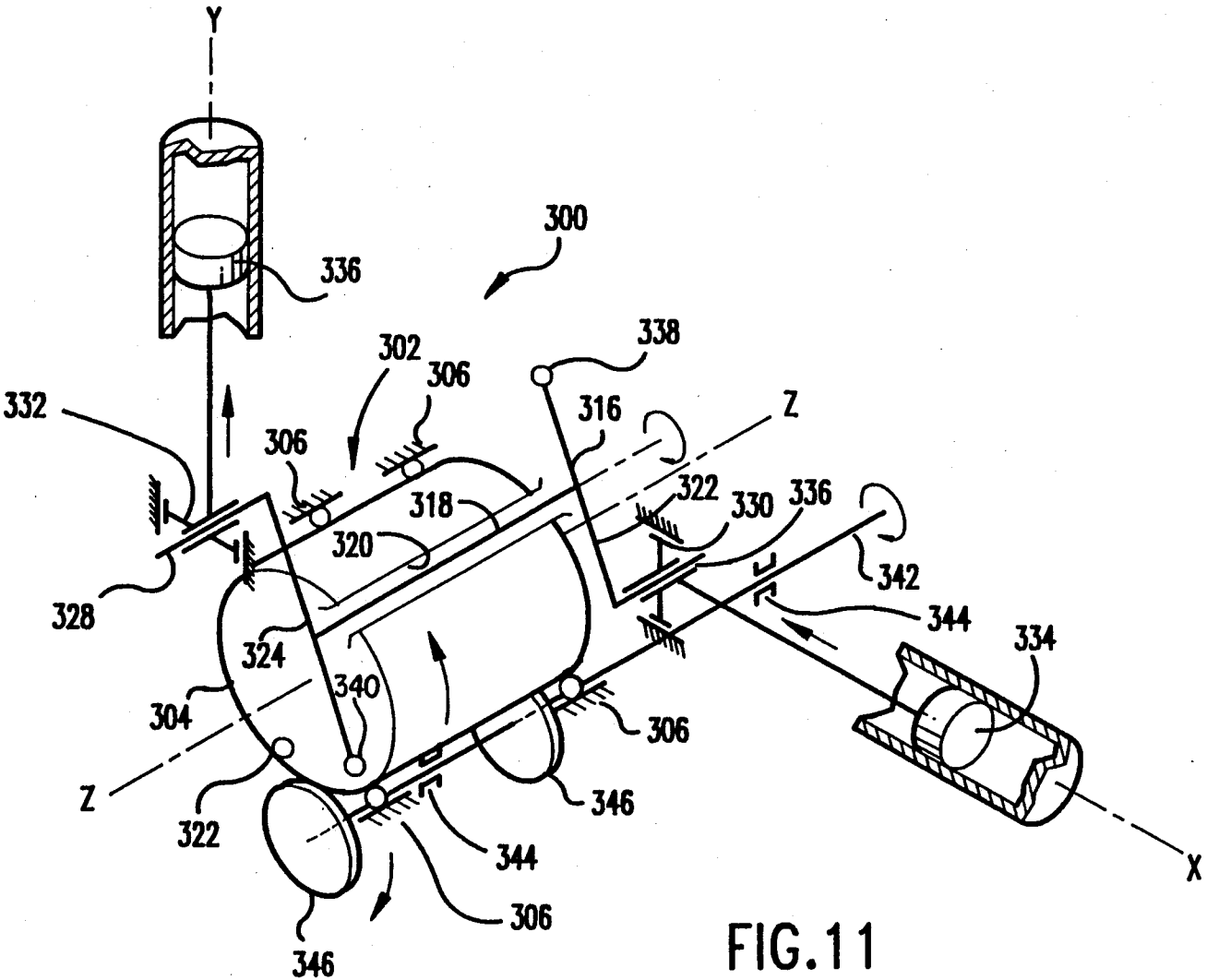
FIG. 11 is a perspective view of a schematic representation of a third embodiment of an internal combustion engine in accordance with the present invention.
Figure 12:
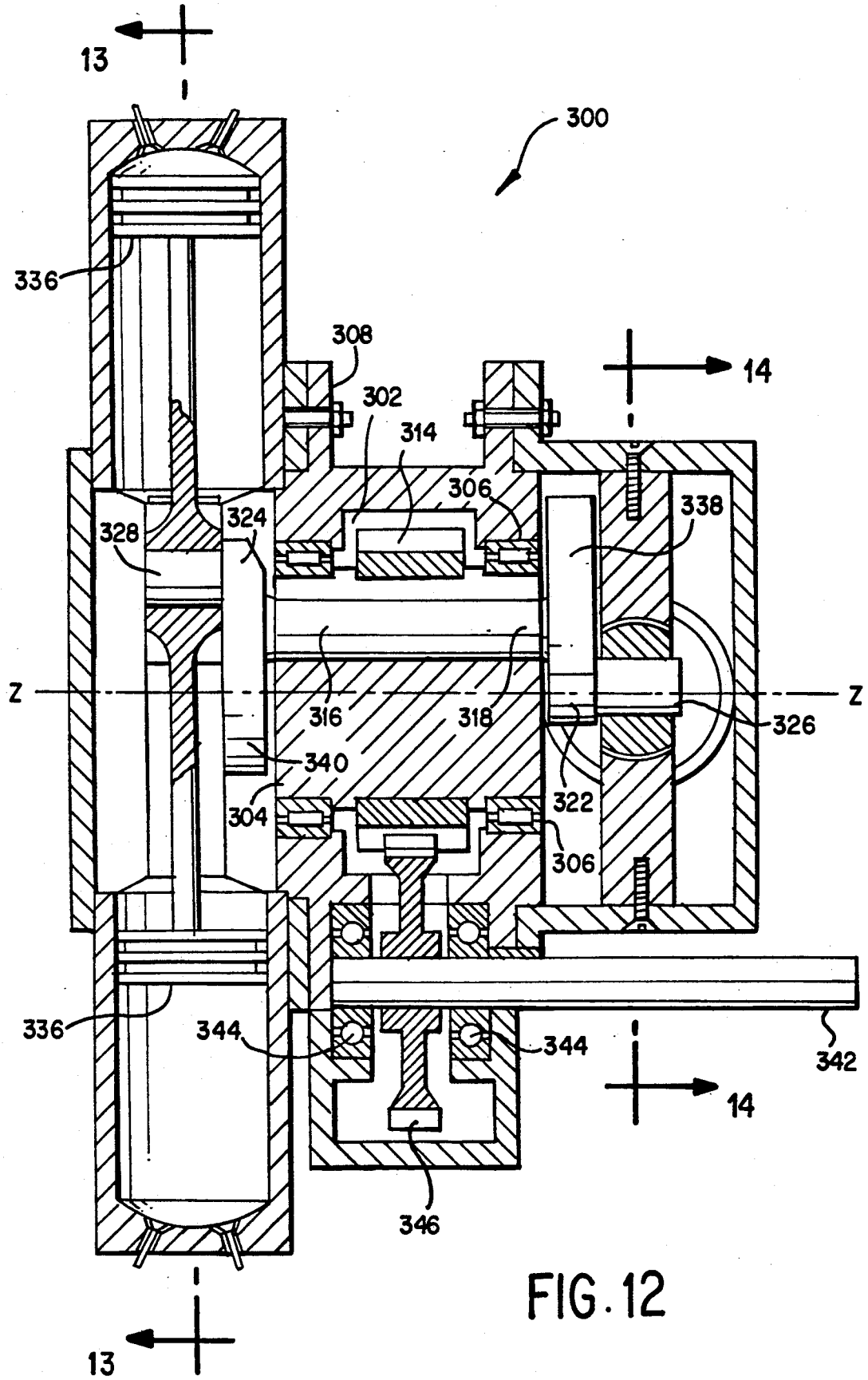
FIG. 12 is a side elevation view, in cross section, of a practical engine in accordance with the third embodiment of the invention.
Figure 13:
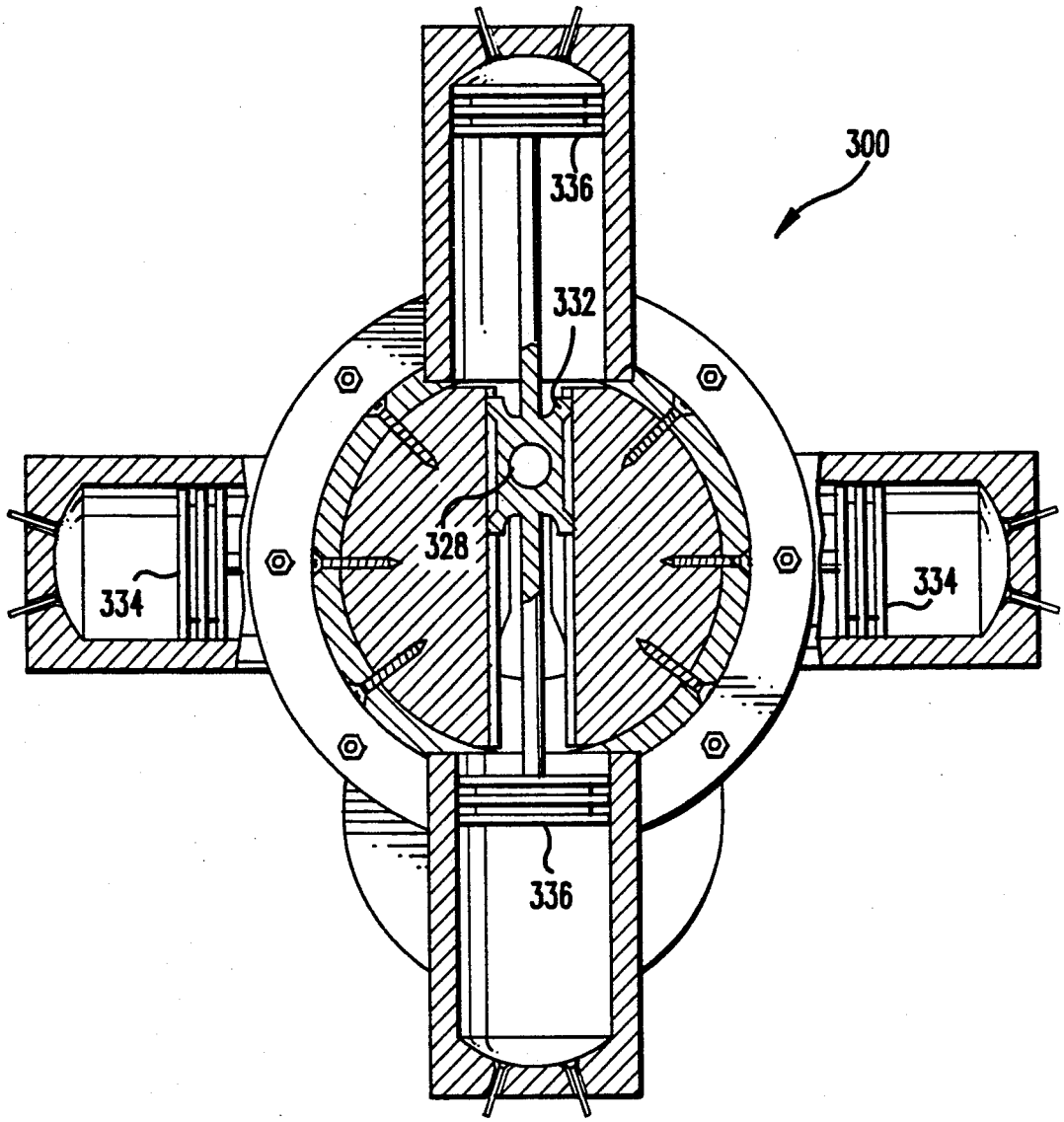
FIGS. 13 and 14 are transverse cross sectional views of the engine of FIG. 12 as seen along the lines 13—13 and 14—14, respectively, in FIG. 12.
Figure 15:
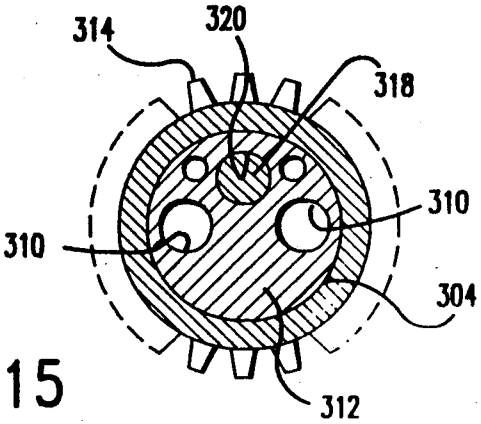
FIG. 15 is an end elevation view, in cross section, of a crank and gear assembly utilized in the engine of FIG. 12.
Figure 14:
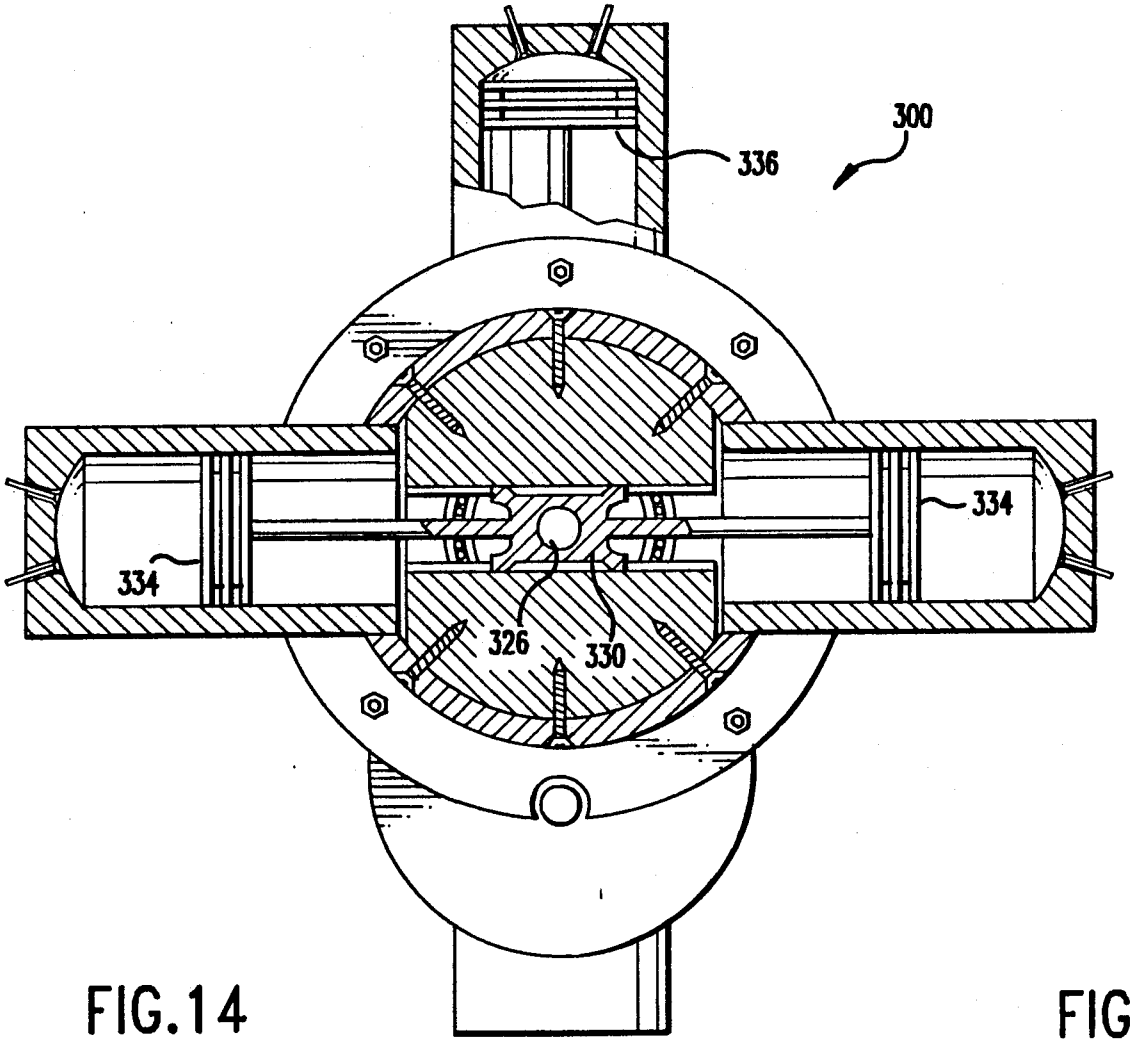

Turning now to the second embodiment illustrated schematically in FIG. 7 and in greater detail in FIGS. 8–10, there is shown an internal combustion engine 200 identical in all respects to the first embodiment except that it does not have a central crank and related components. More particularly, the engine 200 includes an orbital crankshaft 202 that is the same as the crankshaft 128 of the first embodiment except that the central shaft 138 is omitted. As in the first embodiment, the crankshaft 202 includes crank pins 204 and 206 cooperating, as before, with horizontal and vertical piston/cylinder assemblies 208 and 210, respectively.

The engine 200 further includes end crank and gear assemblies 212 and 214, identical to the end assemblies 152 and 154 of the first embodiment, and an output shaft 216 driven by the assemblies 212 and 214 through synchronizing gears 218 and 220 mounted on the shaft 216, all as already described.

In the engine 200, because of the omission of a central crank and gear assembly, the distance D between the X and Y axes (FIG. 8) is smaller than that in the first embodiment.

In light of the differences between the first and second embodiments, the engine 200 of FIGS. 7–10 is lighter and more compact, having a smaller overall length than the engine of the first embodiment. Moreover, the second embodiment is simpler to manufacture and assemble and, because there are fewer frictionally engaging surfaces, its mechanical efficiency is greater. On the other hand, because the orbital crankshaft 202 is supported by only two bearings 222 and 224, the second embodiment is not capable of transmitting as much torque as the first embodiment.

Still further weight and size reductions can be realized with the third embodiment illustrated in FIGS. 11–15. The third embodiment is similar to the first embodiment except that the end crank and gear assemblies and related components are omitted. Instead, the engine 300 of the third embodiment comprises a single crank and gear assembly 302 including an elongated, generally cylindrical crank member 304 journaled for rotation in bearings 306 carried by an engine casing 308. Balancing of the member 304 is attained by eccentric lightening holes 310 (FIG. 15) resulting in the portion 312 of the member 304 functioning as a counterweight. The assembly 302 further includes a ring gear 314 disposed about the central portion of the outer surface of the crank member 304. The crank and gear assembly 302 is driven by an orbital crankshaft 316 having a central, longitudinally extending shaft 318 journaled in a bore 320 extending the length of the crank member 304. The crankshaft 316 further has end cranks 322 and 324 terminating in crank pins 326 and 328, respectively, received by reciprocating guides in the form of slides 330 and 332 driven by pistons 334 and 336, all as described in connection with the previous embodiments. Counterweights 338 and 340 opposite the end cranks 322 and 324 provide the necessary balancing. A shaft 342 supported by bearings 344 and driven by gear 346 in mesh with the ring gear 314 provides output power.

As in the previously described embodiments, the central shaft 318 of the orbital crankshaft 316 moves in a circular path in response to the reciprocating motion of the slides 330 and 332 and crank pins 326 and 328. The resulting uniform angular velocity rotation of the crank and gear assembly 302 drives the output shaft 342 through the gears 314 and 346.

The engine of the third embodiment is smaller, lighter and has fewer parts than the engine of the second embodiment and its mechanical efficiency is greater. However, because the crank pins 326 and 328 are cantilevered, not having the benefit of support from outboard bearings, the third embodiment is used for light duty, small engines.

Figure 16:
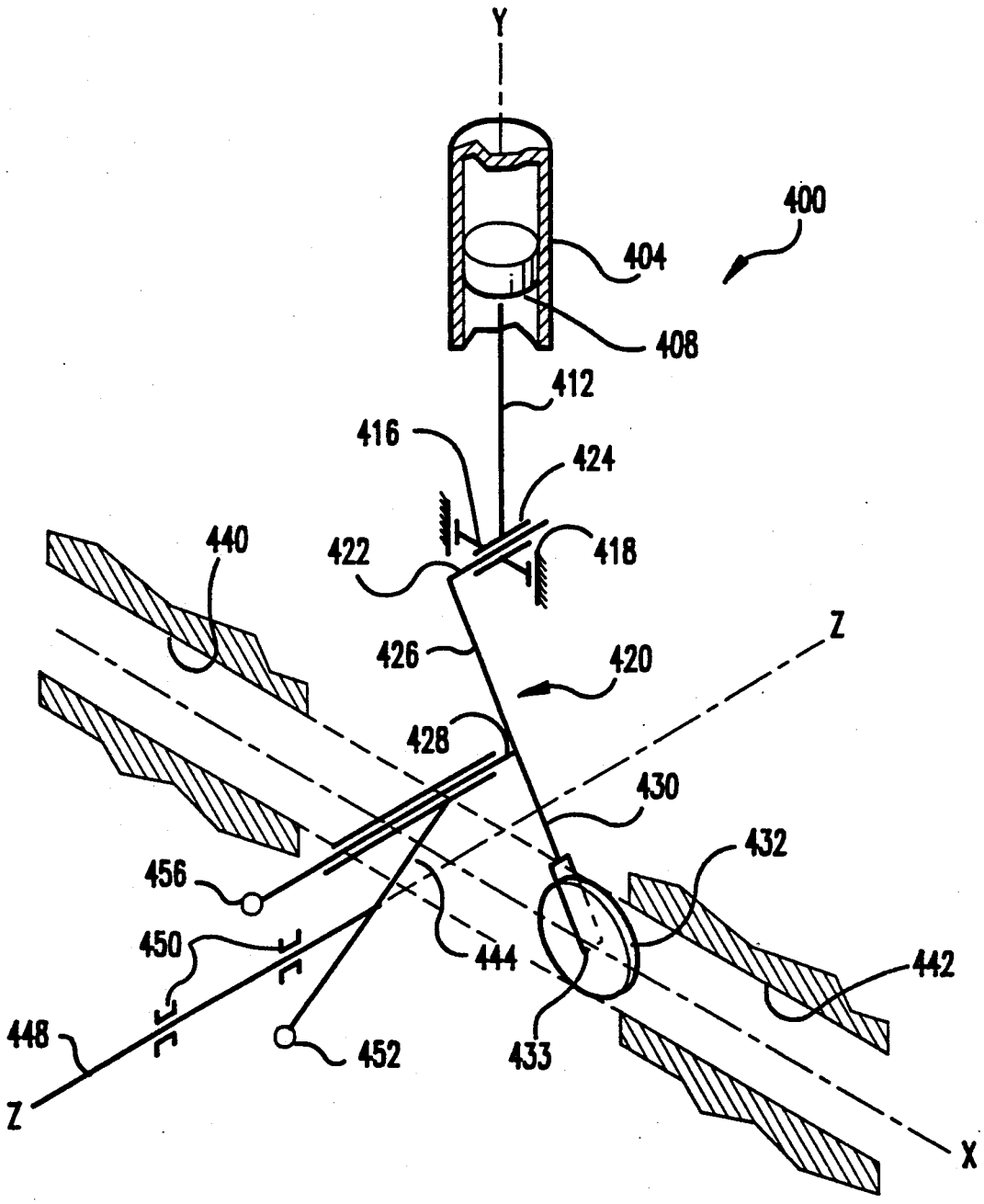
FIG. 16 is a perspective view of a schematic representation of a fourth embodiment of an internal combustion engine in accordance with the present invention.
Figure 17:
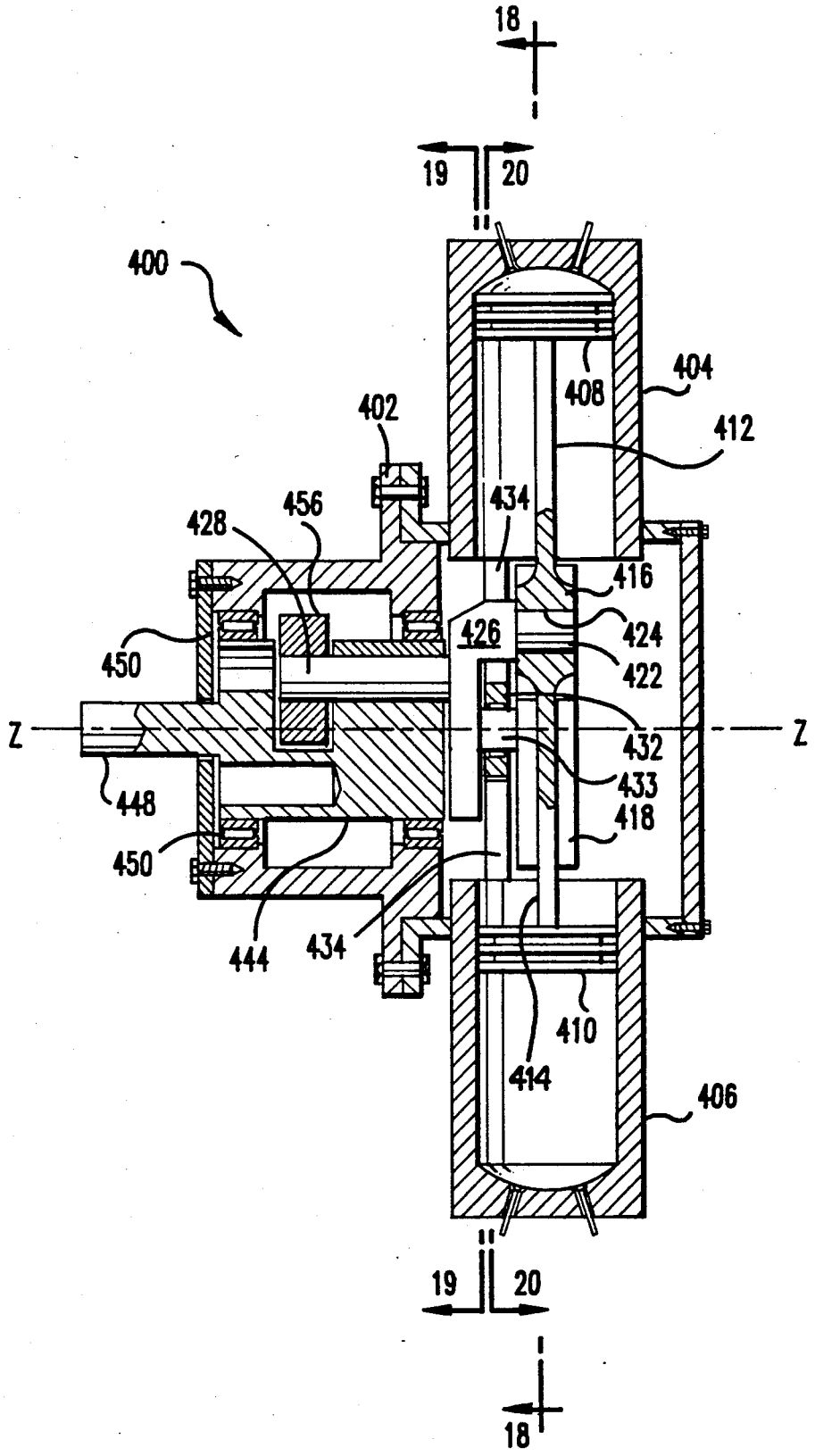
FIG. 17 is a side elevation view, in cross section, of a practical engine in accordance with the fourth embodiment of the invention.
Figure 18:
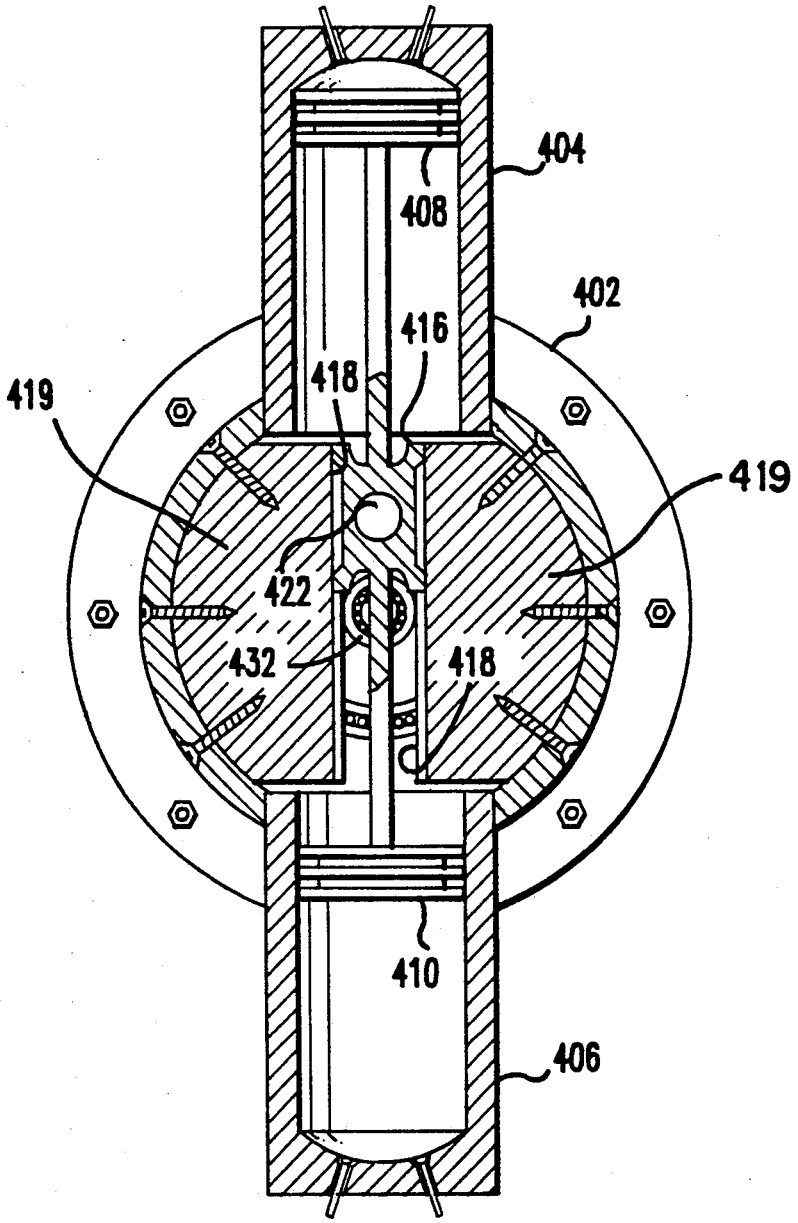
FIGS. 18, 19 and 20 are transverse cross sectional views of the engine of FIG. 17 as seen along the lines 18—18, 19—19 and 20—20, respectively, in FIG. 17.
Figure 19:
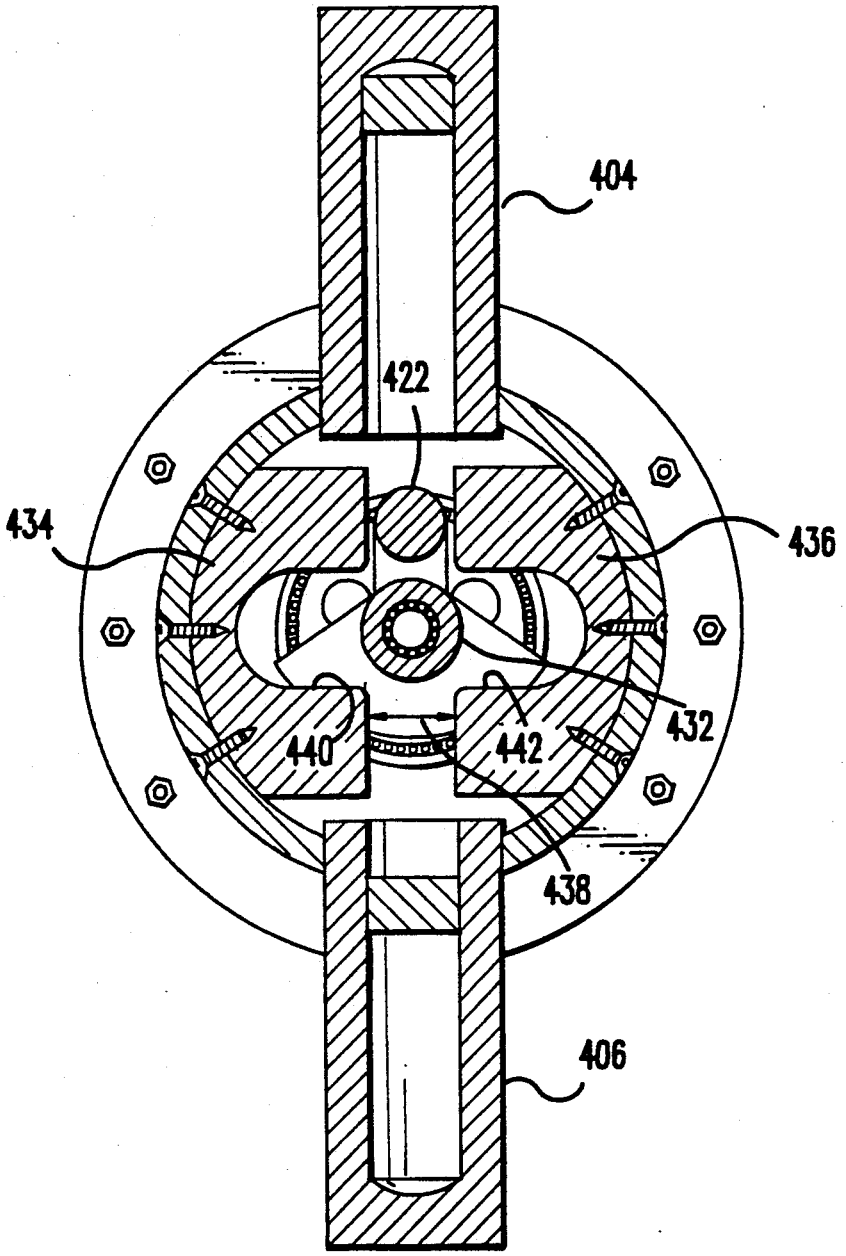
Figure 20:
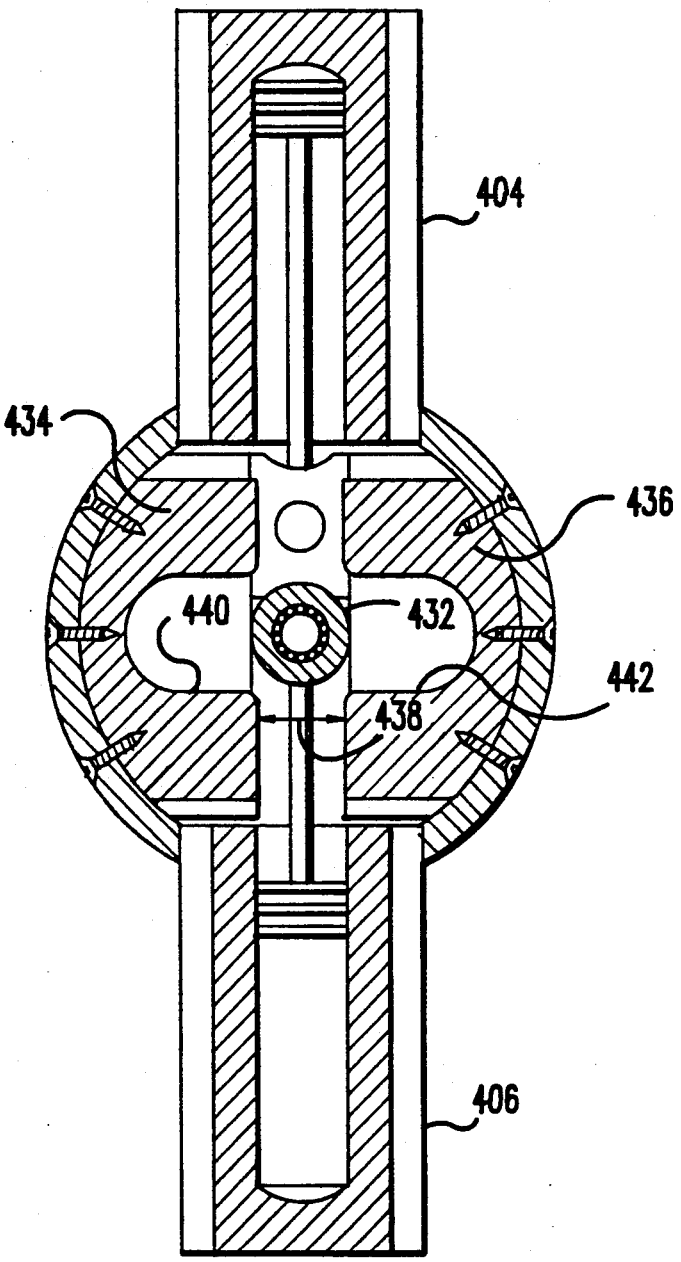
Figure 24:
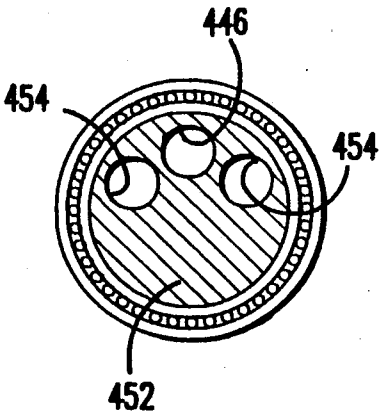
FIGS. 23 and 24 are transverse cross sectional views of the member of FIG. 22 as seen along the lines 23—23 and 24—24, respectively, in FIG. 22.
Figure 23:
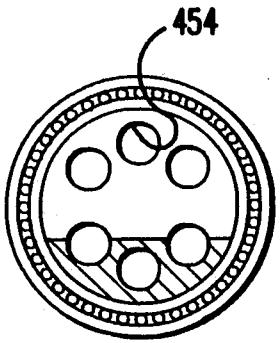
Figure 22:
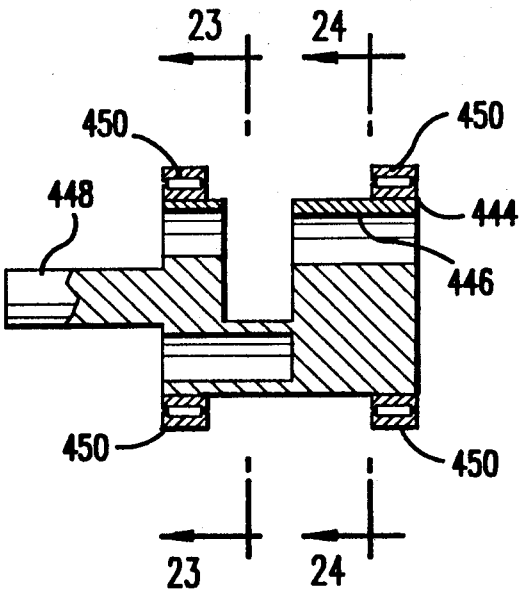
FIG. 22 is a side elevation view, in cross section, of the crank member of FIG. 21 as seen along the line 22—22.
Figure 21:
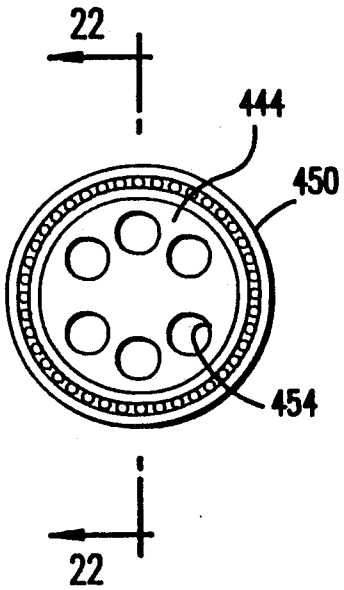
FIG. 21 is an end elevation view of a crank member utilized in the engine of FIG. 17.

In accordance with a fourth embodiment of the invention, shown in FIGS. 16–24, there is provided a 2-cylinder, light duty engine 400 including a casing 402 defining a pair of opposed cylinders 404 and 406 aligned with a Y axis and incorporating pistons 408 and 410, respectively. (Only the cylinder 404 is shown in FIG. 16.) The pistons 408 and 410 are coupled by connecting rods 412 and 414 to a reciprocable guide in the form of a slide 416 received within a linear guideway 418 defined by the parallel edges of a pair of spaced apart, aligned plates 419 (FIG. 18) lying in a plane perpendicular to the Z axis. Appropriate clearance is provided between the slide 416 and its guideway 418 An orbital crankshaft 420 having a crank pin 422 (parallel to a Z axis orthogonal to the Y axis) received by a bore 424 in the slide 416 translates the linear, reciprocating motion of the slide 416 along the Y axis into rotational motion about the Z axis. In this connection, the crankshaft 420 includes a crank 426 coupling the crank pin 422 with a horizontal shaft 428 parallel with the Z axis and rotatable thereabout in a circular orbit. An arm 430, forming an extension of the crank 426 in the schematic representation of FIG. 16, has an end carrying a guide in the form of a rotatable counterwheel 432. The horizontal shaft 428 is connected to the crank 426 at a point midway between the crank pin 422 and the rotational axis or crank pin 433 of the counterwheel 432. The counterwheel 432 is received by a linear guideway 440,442 disposed along an X axis mutually orthogonal to the Y and Z axes. With reference to FIGS. 19 and 20, the guideway is defined by a pair of aligned plates 434 and 436 secured to the engine casing 402 and disposed in a plane perpendicular to the Z axis. The inner, vertical edges of the plates 434 and 436 are separated by a gap 438 (FIGS. 19 and 20). The linear guideway for the counterwheel 432 consists of two sections, namely, a slot or guideway section 440 formed in the plate 434 and a slot or guideway section 442 formed in the plate 436. The guideway sections 440 and 442 are in alignment with each other along the X axis and have rounded corners where they meet the inner edges of the plates 434 and 436. Appropriate clearance is provided between the periphery of the counterwheel 432 and the guideway 440, 442. As best seen in FIG. 17, the plane of the plates 434 and 436—and hence the plane of the guideway sections 440 and 442—are offset along the Z axis from the plates 419 defining the guideway 418.

The counterwheel 432 is the equivalent of slide 26 in FIG. 1 and has essentially the same reciprocating motion. The counterwheel 432 prevents the mechanism of FIGS. 16–24 from jamming when the slide 416 passes through the midpoint of its travel (the counterwheel 432 is then at or near one or the other end of its stroke). The counterwheel also functions as a counterweight, compensating inertial forces caused by the reciprocating pistons 408 and 410, the associated connecting rods 412 and 414, and the slide 416. Taking into consideration the clearances between the slide 416 and its guideway 418 and between the counterwheel 432 and its guideway 440, 442, a kinematic analysis utilizing techniques well known in the art discloses that when the counterwheel is in the middle range of its stroke, the periphery of the counterwheel would not contact the guideway even if the guideway were continuous, that is, even if there were no gap 438. Thus, there is no need to support the counterwheel in the middle of its stroke thereby making possible the gap 438 which provides an unobstructed vertical path for the crank pin 422. (See, for example, FIG. 17.)

The width of the gap 438 should be sufficient to allow for free vertical passage of the structure of the crank pin 422 yet small enough so that the onset of Y direction motion by the counterwheel as it moves away from the middle range of its travel will be intercepted by one or the other of the guideway sections. The counterwheel makes contact with the guideway gradually, that is, with little or no impact.

The rotational counterwheel 432 is preferably mounted on a low friction ball or roller bearing providing the least resistance to the motion of the various movable parts of the engine. It will be evident, however, that a slide element of the kind already described may be used instead.

The shaft 428 is journaled in a generally cylindrical output crank member 444 having a bore 446 receiving the shaft 428. The output crank member includes a power output shaft 448 coaxial of the Z axis and supported by bearings 450. The output crank 444 is provided with a counterweight portion 452 created by lightening holes 454 adjacent the bore 446. A second counterweight 456 is secured to the outer end of the horizontal shaft 428 to compensate inertial and other unbalancing forces.

The operation of the fourth embodiment is similar to the operation of the first three embodiments. Reciprocation of pistons 408 and 410 and slide 416 causes reciprocating motion of the counterwheel 432 and circular motion of the shaft 428 about the Z axis. The motion of the orbiting shaft 428 is translated into rotation of the output shaft 448 through the output crank 444.

Compared with the first three embodiments, the engine of the fourth embodiment has a smaller overall length, weighs less and is simpler to manufacture and assemble. The mechanical efficiency of the fourth embodiment is higher, however, because only one pair of pistons is used and fewer bearings are required. The fourth embodiment cannot deliver as much power, however, and therefore is best applied to light duty, high speed engines having power ranges of up to about one hundred horsepower.

The engine of the present invention may be expected to have longer service life and superior reliability because (1) the pistons do not produce side forces which otherwise wear out the cylinder walls; (2) there is substantially less unit load placed on the crankshaft journals; and (3) there is improved lubrication because the components are operating at low temperatures.

The friction losses of the engine of the present invention are fractions of those of a conventional engine because of the substantial decreases in piston/cylinder friction, the availability of forced slide lubrication and the use of fewer bearing surfaces. Engines according to the invention can therefore provide substantial improvements in fuel economy. Moreover, reduced friction losses make possible substantially higher allowable maximum rotational speeds of the orbital crankshaft, thereby correspondingly increasing the power output of the engine. Further improvements in fuel economy can be realized through use of a lower capacity cooling system made possible by the lower operating temperatures also resulting in reductions in overall weight and cost.

The engine of the present invention operates smoothly and quietly because it is properly balanced. This feature also results in simpler and less expensive engine mounting systems.

The engine of the present invention is considerably smaller in weight and size than conventional engines thereby providing improved specific power. Further, the orbital crankshaft may be made substantially lighter in weight than a conventional crankshaft because it need not carry the entire engine torque.

Moreover, the engine of the present invention may be easily and inexpensively manufactured because (1) there is no need to use expensive wear-resistant alloys since the pistons do not produce side forces affecting the cylinder walls; (2) inexpensive materials can be used to make the required wear-resistant, heavy duty connecting rods, guideways and guides because these components operate at low temperatures and are always well lubricated; (3) there is no need to use sophisticated metal-working equipment because the pistons, rods and guides can be manufactured using relatively simple operations such as turning, milling, boring or drilling; and (4) the components of the engine of the present invention can be manufactured using low precision techniques.

While the invention has been shown and described with reference to four embodiments thereof, it will be appreciated by those having skill in the art that variations in form and detail may be made therein without departing from the spirit and scope of the invention as defined by the accompanying claims.

What is claimed is:

1. In an engine or like apparatus, the combination comprising:

at least one cylinder disposed along a first axis;

a piston reciprocable in the at least one cylinder;

a first linear guideway in alignment with the at least one cylinder;

a first guide in the first guideway, the first guide being coupled to the piston for reciprocation therewith;

a second linear guideway disposed along a second axis, the second axis being orthogonal to the first axis and offset therefrom along a third axis mutually orthogonal to the first and second axes;

a second guide reciprocable in the second guideway;

an orbital crankshaft including crank means having first and second crank pins journaled in the first and second guides, respectively; and means rotatable about the third axis and coupled to the crankshaft at a point midway between the crank pins for providing output power from the engine.

2. The combination, as defined in claim 1, further including:

at least one cylinder disposed along the second axis; and a piston reciprocable in the at least one cylinder disposed along the second axis, the second guide being coupled to the last mentioned piston for reciprocation therewith.

3. The combination, as defined in claim 2, in which:

the means for providing output power includes at least one crank and gear assembly coupled to drive an output shaft disposed in alignment with the third axis.

4. The combination, as defined in claim 1, which includes:

an output shaft in alignment with the third axis, the means for providing output power including an output crank connected to rotate the output shaft.

5. The combination, as defined in claim 4, which includes:

a counterweight connected to the output crank, the counterweight and output crank being on opposite sides of the output shaft.

6. The combination, as defined in claim 4, in which:

the orbital crankshaft includes a shaft extending parallel to the third axis, the shaft having one end connected to the midway point and second end including a counterweight.

7. The combination, as defined in claim 1, in which:

the second guide comprises a counterwheel.

8. The combination, as defined in claim 1, in which:

the second guideway comprises a first guideway section and a second guideway section, said sections being separated by a gap.

9. In an internal combustion engine or like apparatus, the combination comprising:

at least one cylinder disposed along a first axis;

a piston reciprocable in the at least one cylinder;

a first linear guideway in alignment with the at least one cylinder;

a first guide in the first guideway, the first guide being coupled to the piston for reciprocation therewith;

at least one cylinder disposed along a second axis orthogonal to the first axis, the second axis being offset from the first axis along a third axis mutually orthogonal to the first and second axes;

a piston reciprocable in the at least one cylinder disposed along the second axis;

a second linear guideway in alignment with the at least one cylinder disposed along the second axis;

a second guide in the second guideway, the second guide being coupled to the last mentioned piston for reciprocation therewith;

an orbital crankshaft including crank means having first and second crank pins journaled in the first and second guides, respectively; and means rotatable about the third axis and coupled to the crankshaft at a point midway between the crank pins for providing output power from the engine.

10. The combination, as defined in claim 9, in which:

the output power providing means includes at least one crank and gear assembly rotatable about the third axis;

and which includes:

a power output shaft offset from and parallel with the third axis, said shaft being coupled to receive power from the crank and gear assembly.

11. The combination, as defined in claim 10, which includes:

counterweight means secured to the orbital crankshaft; and counterweight means on said at least one crank and gear assembly, said counterweight means compensating for inertial forces and unbalanced moments produced by the crank means and said at least one crank and gear assembly.

12. The combination, as defined in claim 10, in which:

the output power providing means includes two crank and gear assemblies rotatable about and spaced apart along the third axis, each of said assemblies including a gear rotatable about said axis; and the power output shaft including a gear in mesh with the gear on each crank and gear assembly, the power shaft synchronizing the motions of the crank and gear assemblies and maintaining said assemblies in alignment along the third axis.

13. The combination, as defined in claim 10, in which:

the output providing means includes three crank and gear assemblies rotatable about and spaced apart along the third axis, each of said assemblies including a gear rotatable about said axis; and the power output shaft includes a gear in mesh with the gear on each crank and gear assembly, the power shaft synchronizing the motions of the crank and gear assemblies and maintaining the assemblies in alignment with the third axis.

14. In an internal combustion engine or like apparatus, the combination comprising:

a first pair of opposed cylinders disposed along a first axis;

a piston reciprocable in each of the first pair of cylinders, said pistons comprising a first pair of pistons;

a first linear guideway disposed between and in alignment with the first pair of cylinders;

a first guide in the first guideway, the first guide being coupled by connecting rods to the first pair of pistons for reciprocation therewith;

a second pair of opposed cylinders disposed along a second axis orthogonal to the first axis, the second axis being offset from the first axis along a third axis mutually orthogonal to the first and second axes;

a piston reciprocable in each of the second pair of cylinders, said pistons comprising a second pair of pistons;

a second linear guideway disposed between and in alignment with the second pair of cylinders;

a second guide in the second guideway, the second guide being coupled by connecting rods to the second pair of pistons for reciprocation therewith;

an orbital crankshaft including crank means having first and second crank pins journaled in the first and second guides, respectively;

at least one crank and gear assembly coupled to the orbital crankshaft and rotatable about the third axis, said assembly including a gear; and a power output shaft parallel with the third axis and offset therefrom, the power output shaft having a gear in mesh with the gear of the at least one crank and gear assembly.

15. The combination, as d®fin®d in claim 14, in which:

the engine includes a casing;

the at least one crank and gear assembly is supported by bearings carried by the engine casing; and the power output shaft is supported by bearings carried by the engine casing.

16. The combination, as defined in claim 15, in which:

the engine includes a plurality of crank and gear assemblies rotatable about and spaced apart along the third axis, each crank and gear assembly having a gear rotatable about the third axis; and the power output shaft includes a gear in mesh with the gear of each crank and gear assembly, the power shaft synchronizing the motions of the crank and gear assemblies and maintaining the assemblies in alignment along the third axis.

17. The combination, as defined in claim 14, in which:

the orbital crankshaft includes at least one counterweight means; and the at least one crank and gear assembly includes counterweight means, the counterweight means compensating for inertial forces and unbalanced moments.

18. In an engine or like apparatus, the combination comprising:

at least one cylinder disposed along a first axis;

a piston reciprocable in the at least one cylinder;

a first linear guideway in alignment with the at least one cylinder;

a guide in the first guideway, the guide being coupled to the piston for reciprocation therewith;

a second linear guideway disposed along a second axis, the second axis being orthogonal to the first axis and offset therefrom along a third axis mutually orthogonal to the first and second axes, the second guideway comprising a pair of aligned guideway sections separated by a gap;

a rotatable counterwheel reciprocable in the second guideway, said counterwheel traversing said gap in the middle range of its travel;

an orbital crankshaft including crank means having a first crank pin journaled in the guide and a second crank pin carrying the counterwheel, said gap providing an unobstructed path for movement of the first crankpin; and means rotatable about the third axis and coupled to the crankshaft at a point midway between the crank pins for providing output power from the engine.

* * * * *